US009447720B2

(12) United States Patent
Graspeuntner et al.

(10) Patent No.: US 9,447,720 B2
(45) Date of Patent: Sep. 20, 2016

(54) DEVICE FOR INJECTING FUEL INTO THE COMBUSTION CHAMBER OF AN INTERNAL COMBUSTION ENGINE

(75) Inventors: Christian Graspeuntner, Hellein (AT); Gerhard Unterberger, Hof (AT); Franz Guggenbichler, Kuchl (AT)

(73) Assignee: ROBERT BOSCH GMBH, Stuttgart-Feuerbach (DE)

( * ) Notice: Subject to any disclaimer, the term of this patent is extended or adjusted under 35 U.S.C. 154(b) by 686 days.

(21) Appl. No.: 13/882,959

(22) PCT Filed: Nov. 2, 2011

(86) PCT No.: PCT/AT2011/000444

§ 371 (c)(1),
(2), (4) Date: May 1, 2013

(87) PCT Pub. No.: WO2012/058703

PCT Pub. Date: May 10, 2012

(65) Prior Publication Data

US 2013/0220271 A1 Aug. 29, 2013

(30) Foreign Application Priority Data

Nov. 2, 2010 (AT) ..... 1809/2010

(51) Int. Cl.
*F02M 61/14* (2006.01)
*F02B 17/00* (2006.01)
(Continued)

(52) U.S. Cl.
CPC ..... *F02B 17/005* (2013.01); *F02M 47/027* (2013.01); *F02M 61/14* (2013.01); *F02M 61/168* (2013.01); *F02M 2200/31* (2013.01); *F02M 2200/40* (2013.01)

(58) Field of Classification Search
CPC ..... F02M 2200/28; F02M 2200/315; F02M 2200/857; F02M 55/025; F02M 61/14; F02M 2200/80; F02M 69/465
USPC ..... 123/447, 456, 468, 469, 470
See application file for complete search history.

(56) References Cited

U.S. PATENT DOCUMENTS 6,415,768 B1 7/2002 Usui
7,025,045 B2 * 4/2006 Hlousek ..... F02M 47/027 123/447

(Continued)

FOREIGN PATENT DOCUMENTS

CN 1745243 A 3/2006
DE 160785 C 5/1905

(Continued)

OTHER PUBLICATIONS

International Search Report dated Mar. 14, 2012, issued in International Application PCT/AT2011/000444.
(Continued)

*Primary Examiner* — Sizo Vilakazi
(74) *Attorney, Agent, or Firm* — Fitch, Even, Tabin & Flannery LLP

(57) ABSTRACT

A device for injecting fuel into the combustion chamber of an internal combustion engine with at least one injector includes an injector body equipped with a high-pressure accumulator, a nozzle needle axially displaceably guided in the injector and surrounded by a nozzle chamber, a high-pressure line connecting the high-pressure accumulator to the nozzle chamber, and a resonator line arranged in parallel with the high-pressure line and communicating with the nozzle chamber and opening into the high-pressure accumulator via a resonator throttle. The resonator line and the high-pressure line, at least in their sections adjacent the high-pressure accumulator, are formed in a retaining body which, on its end face, is screwed into the accumulator pipe forming the high-pressure accumulator.

7 Claims, 2 Drawing Sheets

Figure 1:
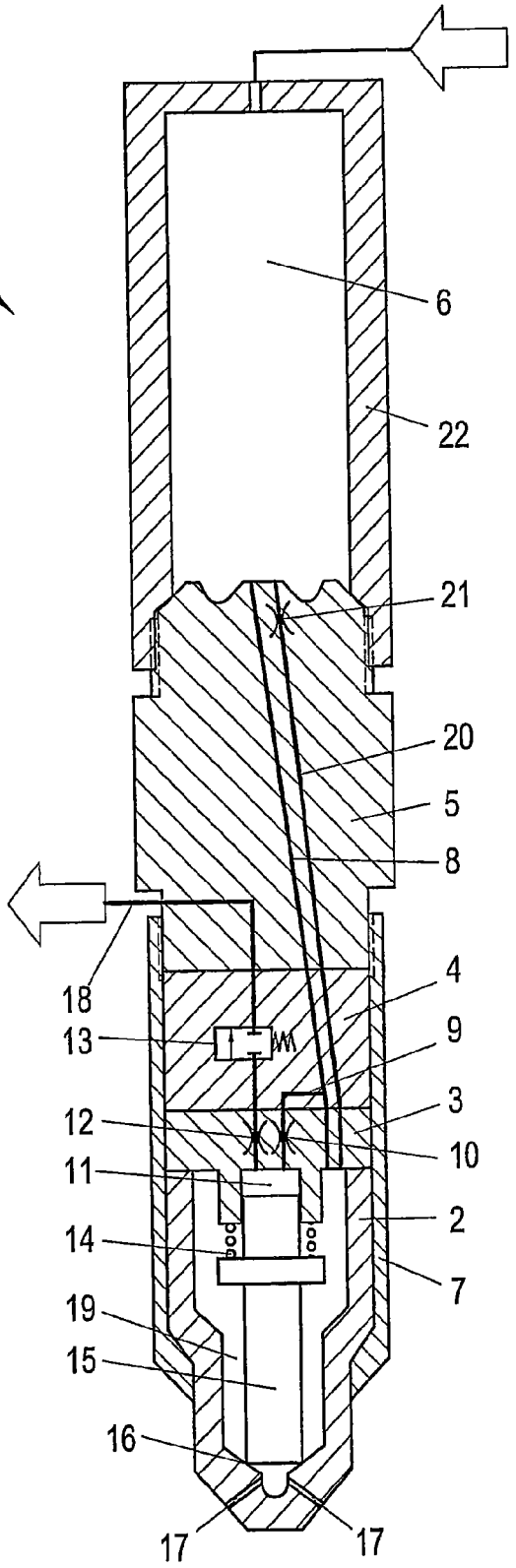

(51) Int. Cl.
*F02M 47/02* (2006.01)
*F02M 61/16* (2006.01)

(56) References Cited

U.S. PATENT DOCUMENTS

| | | | | |
|---|---|---|---|---|
| 7,603,984 | B2 | 10/2009 | Ganser | |
| 7,866,300 | B2 | 1/2011 | Kammerstetter | |
| 2003/0127074 | A1 | 7/2003 | Egler et al. | |
| 2004/0061002 | A1* | 4/2004 | Egler | F02M 47/027 239/533.2 |
| 2008/0296413 | A1* | 12/2008 | Ganser | F02M 47/027 239/533.4 |
| 2010/0263626 | A1* | 10/2010 | Kammerstetter | F02M 47/027 123/337 |
| 2013/0200616 | A1* | 8/2013 | Nussbaumer | F16L 15/00 285/393 |

FOREIGN PATENT DOCUMENTS

| | | | |
|---|---|---|---|
| DE | 100 60 785 | A1 | 7/2001 |
| DE | 10060785 | A1 | 7/2001 |
| DE | 103 07 871 | A1 | 9/2004 |
| DE | 102006051583 | A1 | 5/2008 |
| DE | 10 2008 012 637 | A1 | 9/2009 |
| DE | 102008012637 | A1 | 9/2009 |
| EP | 1 217 202 | A1 | 6/2002 |
| EP | 1 918 570 | A2 | 5/2008 |
| EP | 1 918 570 | A3 | 9/2008 |
| JP | H10213043 | A | 8/1998 |
| JP | 11-093800 | A | 4/1999 |
| JP | 2000205081 | A | 7/2000 |
| JP | 2004332602 | A | 11/2004 |
| JP | 2009501863 | A | 1/2009 |
| JP | 2009540196 | A | 11/2009 |
| WO | 02/46601 | A1 | 6/2002 |
| WO | 02/090753 | A1 | 11/2002 |
| WO | 03/076794 | A1 | 9/2003 |
| WO | 2007/143768 | A1 | 12/2007 |
| WO | 2008/009511 | A1 | 1/2008 |

OTHER PUBLICATIONS

International Preliminary Examination Report issued in International Application PCT/AT2011/000444.

* cited by examiner

DEVICE FOR INJECTING FUEL INTO THE COMBUSTION CHAMBER OF AN INTERNAL COMBUSTION ENGINE

CROSS-REFERENCE TO RELATED APPLICATIONS

This Application is a U.S. National Stage Application filed under 35 U.S.C. §371 of International Application PCT/AT2011/000444, filed Nov. 2, 2011, designating the United States, which claims priority from Austrian Patent Application A 1809/2010, filed Nov. 2, 2010, the complete disclosures of which are hereby incorporated herein by reference in their entirety for all purposes.

The invention relates to a device for injecting fuel into the combustion chamber of an internal combustion engine with at least one injector comprising an injector body equipped with a high-pressure accumulator, a nozzle needle axially displaceably guided in the injector and surrounded by a nozzle chamber, a high-pressure line connecting the high-pressure accumulator to the nozzle chamber, and a resonator line arranged in parallel with the high-pressure line and communicating with the nozzle chamber and opening into the high-pressure accumulator via a resonator throttle.

In a common rail system, electronically controlled injectors are used to inject the fuel into the combustion chamber of an engine. The servo valves employed in such injectors cause the injection nozzle to close very rapidly such that strong pressure pulsations are created on the nozzle seat due to the inertia of the fuel in the consecutive high-pressure bores, which will lead to strong wear. In the most unfavourable cases, the pressure peaks occurring there will be up to 500 bar higher than the rail pressure.

With rapidly successive injection procedures, such pressure oscillations will, moreover, lead to strong deviations of the injection rates. If, for instance, a pressure oscillation is induced on the nozzle seat by a preinjection, the injected amount for the second, subsequent injection, at a constant opening time of the nozzle needle, will depend on whether said second injection has been effected at a maximum or at a minimum of said pressure oscillation. As low pressure oscillation as possible is therefore desirable at the injector in any operating state of the hydraulic system.

In the patent literature, numerous measures have been described to avoid pressure oscillations in hydraulic systems. In most cases, these comprise attenuation volumes, throttle arrangements, valve arrangements or combinations of said measures. Most frequently employed are throttle arrangements, which ought to contribute to the dissipation of the flow energy into static pressure energy.

Thus, it is, for instance, known from EP 1 217 202 A1 to arrange in parallel, in a high-pressure bore departing from a high-pressure line (common rail) and leading to an injector, a non-return valve as well as a dissipation element so as to enable a more rapid attenuation of pressure oscillations.

In order to minimize pressure pulsations in a fuel injection line that is fed from a high-pressure line, a throttle that reduces the cross section of the injection line is provided at the connection site to the high-pressure line according to DE 160 785 A1.

From WO 2007/143768 A1, a configuration can be taken, in which a resonator line arranged in parallel with the high-pressure line between the injector and the high-pressure accumulator is provided, which comprises a resonator throttle on the side of the high-pressure accumulator. The resonator throttle is preferably arranged at the entry of the resonator line into the high-pressure accumulator.

The configuration known from WO 2007/143768 A1 thus provides that the high-pressure line is divided into two mutually independent sections, one of which is equipped with a throttle such that the pressure oscillations created on the nozzle seat are differently reflected in the two sections, and the reflected oscillations are almost extinguished due to their phase offset. In doing so, the function of the hydraulic system is reproduced in exactly the same manner as without throttle, since only the line oscillations are extinguished.

In that case, it is, however, problematic that stresses occur in the transition region of the resonator throttle, wherein micro-movements are to be observed with a rod-shaped resonator element pressed into the body of the high-pressure accumulator, such a configuration of the resonator body as a pressed-in rod resonator thus being no longer usable for system pressures higher than 1800 bar due to these micro-movements, and also due to the limited press-in forces.

The invention, therefore, aims to ensure a safe and stable arrangement of the resonator element even at system pressures higher than 1800 bar, and to reduce the stresses in the transition region of the resonator throttle and the high-pressure bore, respectively.

To solve this object, the invention, departing from a device of the initially defined kind, essentially provides that the resonator line and the high-pressure line, at least in their sections adjacent the high-pressure accumulator, are formed in a retaining body which, on its end face, is screwed into the accumulator pipe forming the high-pressure accumulator. The retaining body thus comprises both the high-pressure bore and the parallelly arranged resonator bore of the resonator element, wherein the fact that the retaining body on its end face is screwed into the accumulator pipe forming the high-pressure accumulator will lead to the establishment of a direct connection between the high-pressure accumulator and the bores of the resonator element and, due to the screw connection, the achievement of an extremely stable connection that is suitable for high system pressures. The screw connection in a simple manner allows for the application of sufficient contact pressures in the region of a conical seat, wherein a preferred configuration in this context provides that the retaining body, on its end face, comprises a conical seating which cooperates with a conical seating on the accumulator pipe for sealing the connection between the retaining body and the accumulator pipe. Such a conical seat results both in an effective sealing and in the stabilization of the retaining body comprising the resonator throttle, thus preventing micro-movements even at high system pressures. If, as in correspondence with a further preferred configuration, the cone angle of the conical seating of the retaining body is smaller than the cone angle of the conical seating of the accumulator pipe, a circular-line contact between the accumulator pipe and the retaining body will be achieved in the region of the conical seat, with a concentration of forces introduced into the respective contact partners occurring along this contact line, wherein the edge of the accumulator pipe might even be pressed into the conical seating of the retaining body in this region, which would further enhance stabilization.

In order to minimize the occurrence of stresses in the transition region between the resonator throttle and the resonator line, it is provided according to a preferred further development that the retaining body, on its end face screwed into the accumulator pipe, comprises an annular recess surrounding the mouth of the resonator line and the mouth of the high-pressure line. In the region of such an annular recess, the fluid pressure prevailing in the high-pressure accumulator can be utilized to introduce into the retaining body forces acting in the direction of said transition region. The forces externally acting on the retaining body in the direction of the transition region in this case act as counter-forces to the forces occurring in said transition region in the resonator line such that, overall, a stabilizing effect will be achieved and undesired local stress situations will be avoided.

An enhanced action in this context will be achieved according to a preferred further development, if the annular recess is surrounded by an annular projection on the end face of the retaining body, said projection having an end face opposite which the mouth of the resonator line is disposed in a manner set back in the axial direction.

In an advantageous manner, it is provided that the diameter of the retaining body corresponds to at least four times, preferably at least eight times, the diameter of the resonator line.

Figure 2:
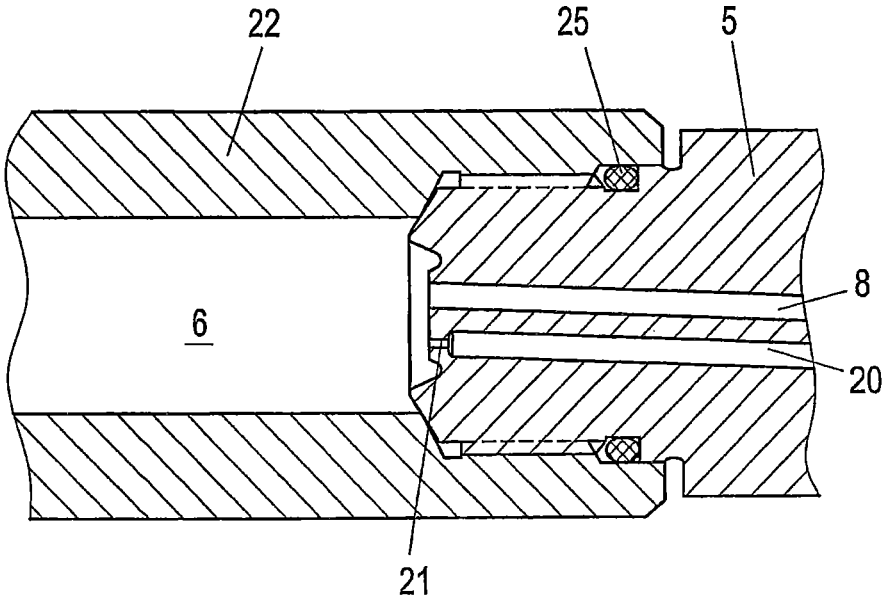
Figure 3:
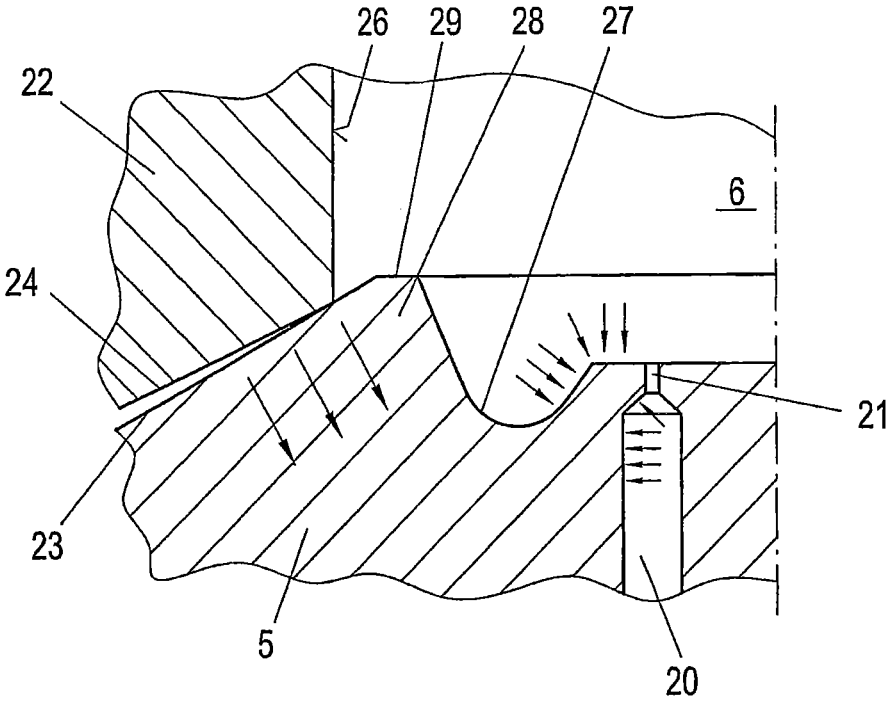

In the following, the invention will be described in more detail by way of an exemplary embodiment schematically illustrated in the drawing. Therein, FIG. 1 schematically depicts a cross section of an injector equipped with a high-pressure accumulator;

FIG. 2 is a detailed view in the region of the retaining body and the high-pressure accumulator; and FIG. 3 is a detailed view of the connecting region between the resonator line and the high-pressure accumulator.

FIG. 1 depicts an injector 1 comprising an injection nozzle 2, a throttle plate 3, a valve plate 4, a supporting body 5 and a high-pressure accumulator 6, wherein a nozzle clamping nut 7 screwed with the supporting body 5 holds together the injection nozzle 2, the throttle plate 3 and the valve plate 4. In the idle state, the solenoid valve 13 is closed such that high-pressure fuel will flow from the high-pressure accumulator 6 into the control chamber 11 of the injection nozzle 2 via the high-pressure line 8, the transverse connection 9 and the inlet throttle 10, yet with the drain from the control chamber 11 via the outlet throttle 12 being blocked on the valve seat of the solenoid valve 13. The system pressure applied in the control chamber 11 together with the force of the nozzle spring 14 presses the nozzle needle 15 into the nozzle needle seat 16 such that the spray holes 17 are closed. When the solenoid valve 13 is actuated, it will enable the passage via the solenoid valve seat, and fuel will flow from the control chamber 11 through the outlet throttle 12, the solenoid valve anchor chamber and the low-pressure bore 18 back into the fuel tank (not illustrated). In the control chamber 11, an equilibrium pressure defined by the flow cross sections of the inlet throttle 10 and the outlet throttle 12 is established, which is so low that the system pressure applied in the nozzle chamber 19 is able to open the nozzle needle 15, which is longitudinally displaceably guided in the nozzle body, so as to clear the spray holes 17 and effect injection.

On account of the inertia of the fuel in the accumulator 6, the high-pressure line 8 and the nozzle chamber 19, heavy pressure oscillations will occur on the nozzle seat 16 immediately upon closing of the nozzle needle 15, since the flowing fuel has to be braked within a very short time. In order to reduce the pressure oscillations, a resonator is used. The latter is comprised of a resonator line 20, which has the same length and the same diameter as the high-pressure line 8, as well as a resonator throttle 21, which is attached to the accumulator-side end of the resonator line 20, connecting the latter to the accumulator 6. When closing the solenoid valve 13, the pressure pulse forming on the nozzle seat 16 will propagate into the high-pressure line 8 and the resonator line 20 via the nozzle chamber 19. On the end of the high-pressure line 8, a reflexion of the pressure pulse on the open end at the transition into the accumulator 6 will take place. At the same time, the pressure pulse running in the resonator line 20 will be reflected on the resonator throttle 21 on the closed end. The two reflected pressure pulses are phase-shifted by 180° due to the different types of reflection (open and closed ends), thus cancelling each other when coming together in the nozzle chamber 19. Consequently, no further pressure pulses will occur on the nozzle seat 16, thus causing considerably less wear there.

From the detailed view according to FIG. 2, it is apparent that the retaining body 5, on its end face, is screwed into the accumulator pipe 22 forming the high-pressure accumulator 6. The retaining body 5, on its end face, has a conical seating 23 which cooperates with a conical seating 24 on the accumulator pipe 22 for sealing the connection between the retaining body 5 and the accumulator pipe 22. An annular seal 25 provides additional sealing.

From FIG. 3, it is apparent that the cone angle of the conical seating 23 of the retaining body 5 is smaller than the cone angle of the conical seating 24 of the accumulator pipe 22, the conical seating 23 of the retaining body 5 projecting from the inner wall 26 of the accumulator pipe 22 into the interior of the high-pressure accumulator 6. It is further apparent that the retaining body 5, on its end face screwed into the accumulator pipe 22, comprises an annular recess 27 surrounding the mouth of the resonator line 20 and the mouth of the high-pressure line 8. The annular recess 27 is surrounded by an annular projection 28 provided on the end face of the retaining body 5, which projection has an end face 29 opposite which the mouth of the resonator line 20, and the resonator throttle 21, are disposed in a manner set back in the axial direction.

The invention claimed is:

1. A device for injecting fuel into the combustion chamber of an internal combustion engine with at least one injector comprising an injector body equipped with a high-pressure accumulator, a nozzle chamber;

a nozzle needle axially displaceably guided in the injector and surrounded by the nozzle chamber, a high-pressure line connecting the high-pressure accumulator to the nozzle chamber, a resonator throttle; and a resonator line arranged in parallel with the high-pressure line and communicating with the nozzle chamber and opening into the high-pressure accumulator via the resonator throttle, wherein the resonator line and the high-pressure line, at least in their sections adjacent the high-pressure accumulator, are formed in a retaining body which, on its end face, is screwed into an accumulator pipe forming the high-pressure accumulator, and wherein the retaining body, on its end face screwed into the accumulator pipe, comprises an annular recess surrounding the mouth of the resonator line and the mouth of the high-pressure line.

2. A device according to claim 1, wherein the accumulator pipe has a conical seating; and the retaining body, on its end face, comprises a conical seating which cooperates with the conical seating on the accumulator pipe for sealing the connection between the retaining body and the accumulator pipe.

3. A device according to claim 2, wherein a cone angle of the conical seating of the retaining body has a cone angle smaller than a cone angle of the conical seating of the accumulator pipe.

4. A device according to claim 2, wherein the conical seating of the retaining body projects from an inner wall of the accumulator pipe into an interior of the high-pressure accumulator.

5. A device according to claim 1 wherein the annular recess is surrounded by an annular projection on the end face of the retaining body, said projection having an end face opposite which the mouth of the resonator line is disposed in a manner set back in an axial direction.

6. A device according to claim 1, wherein a diameter of the retaining body corresponds to at least four times a diameter of the resonator line.

7. A device according to claim 1, wherein a diameter of the retaining body corresponds to at least eight times a diameter of the resonator line.

* * * * *